US012604998B2

(12) United States Patent
Howe et al.

(10) Patent No.: US 12,604,998 B2
(45) Date of Patent: Apr. 21, 2026

(54) COLLAPSIBLE DISPLAY BENCH

(71) Applicant: Fernlea Flowers Limited, Delhi (CA)

(72) Inventors: Jeffrey Lloyd Howe, Turkey Point (CA); Bob IJpelaar, Aalsmeer (NL)

(73) Assignee: Fernlea Flowers Limited, Delhi (CA)

( * ) Notice: Subject to any disclaimer, the term of this patent is extended or adjusted under 35 U.S.C. 154(b) by 0 days.

(21) Appl. No.: 18/807,105

(22) Filed: Aug. 16, 2024

(65) Prior Publication Data

US 2025/0057336 A1 Feb. 20, 2025

Related U.S. Application Data

(60) Provisional application No. 63/519,927, filed on Aug. 16, 2023.

(51) Int. Cl.
*A47F 5/10* (2006.01)
*A47F 5/00* (2006.01)

(52) U.S. Cl.
CPC ..... *A47F 5/10* (2013.01); *A47F 5/0018* (2013.01)

(58) Field of Classification Search
CPC ..... A47F 5/10; A47F 5/0018; A47B 46/00; A47B 96/027
See application file for complete search history.

(56) References Cited

U.S. PATENT DOCUMENTS 291,030 A 1/1884 Clapper
412,146 A * 10/1889 Whitehouse ..... A47B 3/12 211/181.1
548,273 A * 10/1895 Rouse ..... F16M 13/02 211/195
1,146,488 A * 7/1915 Finkelstein ..... A47B 3/12 108/101
1,986,078 A * 1/1935 Spang ..... A47F 5/0018 211/150
3,041,033 A * 6/1962 Schwartz ..... A47B 96/061 248/248
3,322,077 A * 5/1967 Kovacik ..... A47B 3/00 108/115
3,565,020 A * 2/1971 Schier ..... A47B 96/028 211/186
3,730,108 A 5/1973 Stroh
3,794,183 A * 2/1974 Colbridge ..... A47B 46/00 211/208
5,236,095 A * 8/1993 Krizka ..... A47B 47/00 211/96

(Continued)

FOREIGN PATENT DOCUMENTS

KR 200169278 Y1 2/2000
KR 200457042 Y1 * 12/2011

*Primary Examiner* — Stanton L Krycinski
(74) *Attorney, Agent, or Firm* — The Webb Law Firm

(57) ABSTRACT

A collapsible display bench including at least one horizontal bracing and two frames that are mirrored versions of each other; the frames including a leg; at least one arm; and a post, wherein, the arm comprises a horizontal beam connected to two vertical shelf supports wherein there is a notch at the top of the vertical shelf support, the notches comprising large rounded openings. A method of collapsing the collapsible display bench by individually rotating the at least one arms and legs towards the horizontal bracing. A method of collapsing the collapsible display bench by rotating each frame towards the horizontal bracing.

20 Claims, 6 Drawing Sheets

(56) References Cited

U.S. PATENT DOCUMENTS 5,477,971 A * 12/1995 Howard ..... A47F 5/101 211/187
5,505,318 A * 4/1996 Goff ..... A47B 46/00 211/90.03
5,555,954 A * 9/1996 Swiderski ..... E04G 1/34 182/119
5,592,887 A * 1/1997 Teng ..... A47B 21/00 108/163
5,765,702 A * 6/1998 Bustos ..... A47F 5/137 280/47.21
5,833,082 A 11/1998 Barthel
6,659,295 B1 * 12/2003 De Land ..... A47B 96/04 211/187
6,994,034 B2 * 2/2006 Chang ..... A47B 21/00 108/115
7,185,899 B2 * 3/2007 Thiede ..... A47B 46/00 280/47.35
7,314,143 B1 * 1/2008 Johnson ..... A47B 57/487 211/106
7,360,627 B2 * 4/2008 Scott ..... A47B 96/061 182/150
7,708,156 B2 * 5/2010 Johnson ..... A47B 57/487 211/106
7,815,202 B2 * 10/2010 Richards ..... A47F 5/135 211/195
9,271,570 B2 * 3/2016 Ceballos Godefroy .. A47F 5/10
9,357,840 B2 * 6/2016 Davis ..... A47B 91/00
9,701,486 B2 * 7/2017 Finck ..... B65G 49/061
9,770,102 B2 * 9/2017 Conod ..... A47B 47/0083
9,821,828 B2 * 11/2017 Kahler ..... B62B 3/10
9,901,169 B1 * 2/2018 Schenker ..... A47B 96/021
9,918,568 B1 * 3/2018 Blake ..... A47G 25/0678
10,182,650 B1 * 1/2019 Schenker ..... A47B 43/00
10,226,661 B2 * 3/2019 Henniger ..... A63B 21/4035
10,470,566 B1 * 11/2019 Rabbany ..... A47B 96/07
10,953,301 B2 * 3/2021 Brasch ..... A63B 23/03525
10,971,038 B2 * 4/2021 Shea ..... G09F 7/08
11,224,289 B1 * 1/2022 Hutson ..... A47B 96/1408
2003/0057171 A1 * 3/2003 Wang ..... A47B 43/00 211/85.15
2004/0094075 A1 * 5/2004 Norstad ..... A47F 5/13 108/115
2005/0034922 A1 * 2/2005 Wyse ..... E04G 1/30 182/119
2011/0031200 A1 * 2/2011 Chen ..... A47B 43/00 211/149
2019/0126088 A1 * 5/2019 Henniger ..... A63B 23/1218
2022/0016466 A1 * 1/2022 Henniger ..... A63B 21/078

* cited by examiner

COLLAPSIBLE DISPLAY BENCH

CROSS-REFERENCE TO RELATED APPLICATIONS

This application claims priority to U.S. Provisional Patent Application Ser. No. 63/519,927, titled "Collapsible Display Bench" and filed on Aug. 16, 2023, the disclosure of which is incorporated herein in its entirety.

BACKGROUND OF THE INVENTION

Field of the Invention

The present invention relates to a collapsible display bench. The collapsible display bench can be used to display any good, particularly plants and flowers, in a commercial setting.

Description of Related Art

Display racks currently on the market are not easily storable, once they are set up it requires significant effort and multiple people in order to adjust the shelf heights and widths, as well as disassemble display racks for storage. Therefore, there is a current need in the industry to have a display rack that is easily collapsible and/or adjustable.

SUMMARY OF THE INVENTION

The present invention is directed to a collapsible display bench including at least one horizontal bracing; two frames that are mirrored versions of each other; the frames comprising: a leg with a proximal end and a distal end; at least one arm; wherein, the arm comprises a horizontal beam with a proximal end and a distal end orthogonally connected to two vertical shelf supports one at the distal end of the horizontal beam and the other disposed a distance along the length of the horizontal beam, wherein there is a notch at the top of the vertical shelf support, the notches comprising large rounded openings; a post with an upper end and lower end; wherein, the post has at least three plate sets disposed along the height of the post, one plate set at the lower end of the post positioned forward, at least one plate set on parallel to the plate set at the lower end of the post, and at least one plate set facing inward perpendicular to the plate set at the lower end of the post, wherein the proximal end of the leg is connected to the lower end of post wherein the two frames are parallel to each other and the posts of the two frames connected to the either end of the at least one horizontal bracing. In a preferred embodiment, the collapsible display bench has two horizontal bars, but it is understood that the bench could have any number of horizontal bars.

In some embodiments, the horizontal bracing includes a first end and a second end wherein both ends are rounded and have two vertical through holes. In further embodiments, the two frames are parallel to each other and the posts of the two frames connected to the either end of the at least one horizontal bracing by aligning the through holes of the first end of the at least one horizontal bracing with the plate set perpendicular to the plate set at the lower end of the post of one frame and the second end of the at least one horizontal bracing with the plate set perpendicular to the plate set at the lower end of the post of the other frame and securing them with a bolt in each hole respectively.

In other embodiments, the proximal end of the leg has two vertical through holes and is rounded. Further, the proximal end of the leg can be connected to the lower end of post by aligning the through holes of the proximal end of the leg and the plate set at the lower end of the post and securing them with a bolt in each hole respectively, and the proximal end of the arm is connected to the post by aligning the through holes of the proximal end of the arm and the plate set parallel to the plate set at the lower end of the post and securing them with a bolt in each hole respectively.

In some embodiments, the proximal end of the horizontal beam has two vertical through holes and is rounded. In further embodiments, the plate sets comprises two plates arranged parallel to each other at a height substantially equivalent to the height of the leg, arm, and at least one horizontal bracing respectively, with two through holes. In further embodiments, the head of each bolt is fit for a hex key.

In some embodiments, the vertical shelf support has at least one additional notch, each additional notch at a substantially identical height on each vertical shelf support.

In certain embodiments, an end cap is placed on the distal end of the legs, the upper end of the posts and the tops of the vertical shelf supports. In other embodiments, the vertical shelf supports and posts have holes on the outside face of the collapsible display bench to allow a banner to be fixed to the collapsible display bench.

In some embodiments, the collapsible display bench, further includes: a rod, with a lower end, upper end, and at least two through holes along the rod, wherein the upper end of the rod has a holder to hold a sign, wherein there is a tube perpendicularly attached to the at least one horizontal bracing, the interior is the same shape as the exterior of the rod and the tube has a through hole, wherein the rod is disposed with in the tube and fixed in a position by aligning one through hole of the rod with the through hole of the tube and securing with a bolt the lower end of the rod is connected to the at least one horizontal bracing.

In other embodiments, the holder comprises: a U-shaped cross section extended perpendicular to the rod; and, at least one backing support bisecting the U-shaped cross section.

The invention also includes a method of using the collapsible display bench including: using a hex key to loosen a bolt from one of the two through holes of each of the plate sets, removing the loosened bolt from each of the plate sets; rotating the at least one arm of a frame inwards towards the at least one horizontal bracing; rotating the at least one arm of the other frame inwards towards the at least one horizontal bracing; rotating the leg of a frame inwards towards the at least one horizontal bracing; and rotating the leg of the other frame inwards towards the at least one horizontal bracing.

In certain embodiments, the method of claim further includes: securing the distal end of at least one arm of a frame to at least one horizontal bracing, securing the distal end of at least one arm of the other frame to at least one horizontal bracing, securing the distal end of the leg of a frame to at least one horizontal bracing, securing the distal end of the leg of the other frame to at least one horizontal bracing.

In further embodiments, the at least one arm of a frame is secured to at least one horizontal bracing by a bracket, the distal end of at least one arm of the other frame is secured to at least one horizontal bracing by a bracket, the distal end of the leg of a frame is secured to at least one horizontal bracing by a bracket, the distal end of the leg of the other frame is secured to at least one horizontal bracing by a bracket.

This invention includes a second method of using the collapsible display bench including: using a hex key to loosen a bolt from one of the two through holes of the plate set securing the at least one horizontal bracing; removing the loosened bolt from the plate sets; rotating a frame inwards towards the horizontal bracing; rotating the other frame inwards towards the at least one horizontal bracing.

In certain embodiments, the method further includes securing the distal end of at least one arm of a frame to at least one horizontal bracing, securing the distal end of at least one arm of the other frame to at least one horizontal bracing, securing the distal end of the leg of a frame to at least one horizontal bracing, securing the distal end of the leg of the other frame to at least one horizontal bracing.

In further embodiments, the at least one arm of a frame is secured to at least one horizontal bracing by a bracket, the distal end of at least one arm of the other frame is secured to at least one horizontal bracing by a bracket, the distal end of the leg of a frame is secured to at least one horizontal bracing by a bracket, the distal end of the leg of the other frame is secured to at least one horizontal bracing by a bracket.

CLAUSES

Clause 1: A collapsible display bench comprising: at least one horizontal bracing; two frames that are mirrored versions of each other; the frames comprising: a leg with a proximal end and a distal end; and at least one arm; wherein, the arm comprises a horizontal beam with a proximal end and a distal end orthogonally connected to two vertical shelf supports one at the distal end of the horizontal beam and the other disposed a distance along the length of the horizontal beam, wherein there is a notch at the top of the vertical shelf support, a post with an upper end and lower end; wherein, the post has at least three plate sets disposed along the height of the post, one plate set at the lower end of the post positioned forward, at least one plate set on parallel to the plate set at the lower end of the post, and at least one plate set facing inward perpendicular to the plate set at the lower end of the post, wherein the proximal end of the leg is connected to the lower end of post wherein the two frames are parallel to each other and the posts of the two frames connected to the either end of the at least one horizontal bracing.

Clause 2: The collapsible display bench of Clause 1, wherein the horizontal bracing comprises: a first end and a second end wherein both ends are rounded and have two vertical through holes.

Clause 3: The collapsible display bench of Clauses 1 or 2, wherein the two frames are parallel to each other and the posts of the two frames connected to the either end of the at least one horizontal bracing by aligning the through holes of the first end of the at least one horizontal bracing with the plate set perpendicular to the plate set at the lower end of the post of one frame and the second end of the at least one horizontal bracing with the plate set perpendicular to the plate set at the lower end of the post of the other frame and securing them with a bolt in each hole respectively.

Clause 4: The collapsible display bench of any of the clauses 1-3, wherein the proximal end of the leg has two vertical through holes and is rounded.

Clause 5: The collapsible display bench of any of the clauses 1-4, wherein the proximal end of the leg is connected to the lower end of post by aligning the through holes of the proximal end of the leg and the plate set at the lower end of the post and securing them with a bolt in each hole respectively, and the proximal end of the arm is connected to the post by aligning the through holes of the proximal end of the arm and the plate set parallel to the plate set at the lower end of the post and securing them with a bolt in each hole respectively.

Clause 6: The collapsible display bench of any of the clauses 1-5, wherein, the proximal end of the horizontal beam has two vertical through holes and is rounded.

Clauses 7: The collapsible display bench of any of the clauses 1-6, wherein, the plate sets comprises two plates arranged parallel to each other at a height substantially equivalent to the height of the leg, arm, and horizontal bracing respectively, with two through holes.

Clause 8: The collapsible display bench of any of the clauses 1-7, wherein the head of each bolt is fit for a hex key.

Clause 9: The collapsible display bench of any of the clauses 1-8, wherein the notch comprises a rounded opening.

Clause 10: The collapsible display bench of any of the clauses 1-9, wherein there is at least one additional notch on each vertical shelf support, each additional notch at a substantially identical height on each vertical shelf support.

Clause 11: The collapsible display bench of any of the clauses 1-10, wherein an end cap is placed on the distal end of the legs, the upper end of the posts and the tops of the vertical shelf supports.

Clause 12: The collapsible display bench of any of the clauses 1-11, wherein the vertical shelf supports and posts have holes on the outside face of the collapsible display bench to allow a banner to be fixed to the collapsible display bench.

Clause 13: The collapsible display bench of any of the clauses 1-12, further comprising: a rod, with a lower end, upper end, and at least two through holes along the rod, wherein the upper end of the rod has a holder to hold a sign, wherein there is a tube perpendicularly attached to the at least one horizontal bracing, the interior is the same shape as the exterior of the rod and the tube has a through hole, wherein the rod is disposed with in the tube and fixed in a position by aligning one through hole of the rod with the through hole of the tube and securing with a bolt.

Clause 14: The collapsible display bench of any of the clauses 1-13, wherein the holder comprises: a U-shaped cross section extended perpendicular to the rod; and, at least one backing support bisecting the U-shaped cross section.

Clause 15: A method of using a collapsible display bench comprising: providing a collapsible bench as recited in any of the clauses 1-14; using a hex key to loosen a bolt from one of the two through holes of each of the plate sets, removing the loosened bolt from each of the plate sets; rotating the at least one arm of a frame inwards towards the at least one horizontal bracing; rotating the at least one arm of the other frame inwards towards the at least one horizontal bracing; rotating the leg of a frame inwards towards the at least one horizontal bracing; and rotating the leg of the other frame inwards towards the horizontal bracing.

Clause 16: The method of Clause 15 further comprising: securing the distal end of at least one arm of a frame to at least one horizontal bracing, securing the distal end of at least one arm of the other frame to at least one horizontal bracing, securing the distal end of the leg of a frame to at least one horizontal bracing, securing the distal end of the leg of the other frame to at least one horizontal bracing.

Clause 17: The method of any of the clauses 15 or 16 wherein, the at least one arm of a frame is secured to at least one horizontal bracing by a bracket, the distal end of at least one arm of the other frame is secured to at least one horizontal bracing by a bracket, the distal end of the leg of a frame is secured to at least one horizontal bracing by a bracket, the distal end of the leg of the other frame is secured to at least one horizontal bracing by a bracket.

Clause 18: A method of using a collapsible display bench comprising: providing a collapsible display bench as recited in any of the clauses 1-14; using a hex key to loosen a bolt from one of the two through holes of the plate set securing the at least one horizontal bracing; removing the loosened bolt from the plate sets; rotating a frame inwards towards the at least one horizontal bracing; rotating the other frame inwards towards the at least one horizontal bracing.

Clause 19: The method of Clause 18 further comprising: securing the distal end of at least one arm of a frame to at least one horizontal bracing, securing the distal end of at least one arm of the other frame to at least one horizontal bracing, securing the distal end of the leg of a frame to at least one horizontal bracing, securing the distal end of the leg of the other frame to at least one horizontal bracing.

The method of any of the clauses 18 or 19 wherein, the at least one arm of a frame is secured to at least one horizontal bracing by a bracket, the distal end of at least one arm of the other frame is secured to at least one horizontal bracing by a bracket, the distal end of the leg of a frame is secured to at least one horizontal bracing by a bracket, the distal end of the leg of the other frame is secured to at least one horizontal bracing by a bracket.

DESCRIPTION OF THE INVENTION

Figure 2:
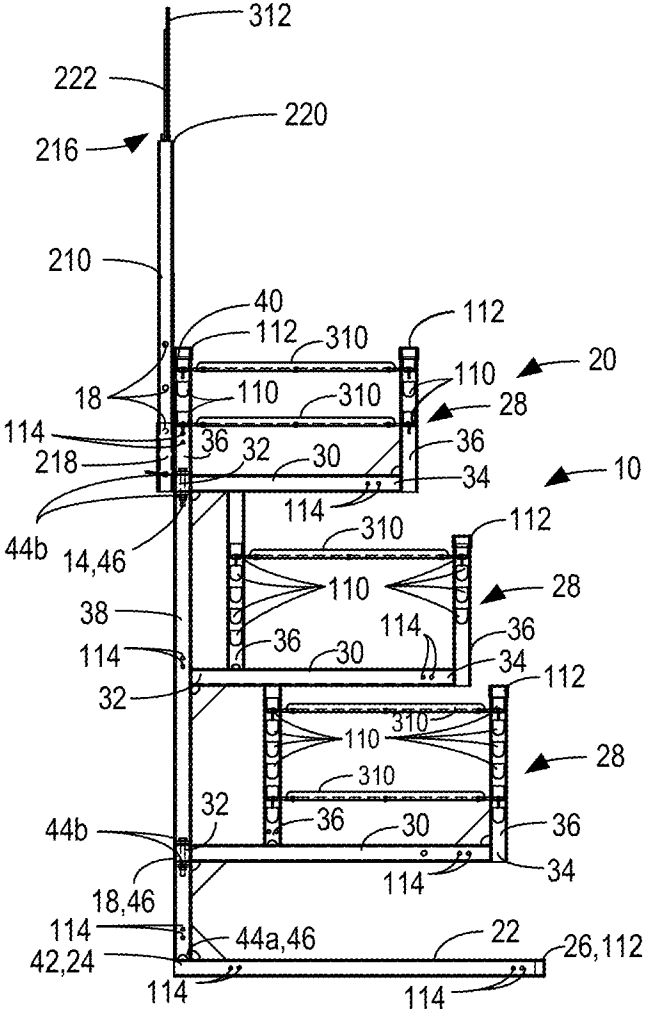
FIG. 2 shows a perspective view of collapsible display bench with a sign and shelves shown in FIG. 1.

As used herein, the singular form of "a", "an", and "the" include plural referents unless the context clearly dictates otherwise.

Spatial or directional terms, such as "left", "right", "inner", "outer", "above", "below", and the like, relate to the invention as shown in the drawing figures and are not to be considered as limiting as the invention can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C.

The term "adjacent" means proximate to but not in direct contact with.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

FIGS. 1-4 refer to a collapsible display bench 10 including at least one horizontal bracing 12 and two frames 20 that are mirrored versions of each other. The embodiment shown in FIGS. 1-4 include two horizontal bracings 12, but the collapsible display bench 10 may include any number of horizontal bracings 12. The frames 20 include a leg 22, at least one arm 28, and a post 38. The arm 28 includes a horizontal beam 30 connected to two vertical shelf supports 36. A notch 110 is provided at the top of the vertical shelf support 36. The notches 110 include large rounded openings. The two frames 20 are parallel or substantially parallel to each other and the posts 38 of the two frames 20 are connected to either end of the horizontal bracing 12.

Figure 1:
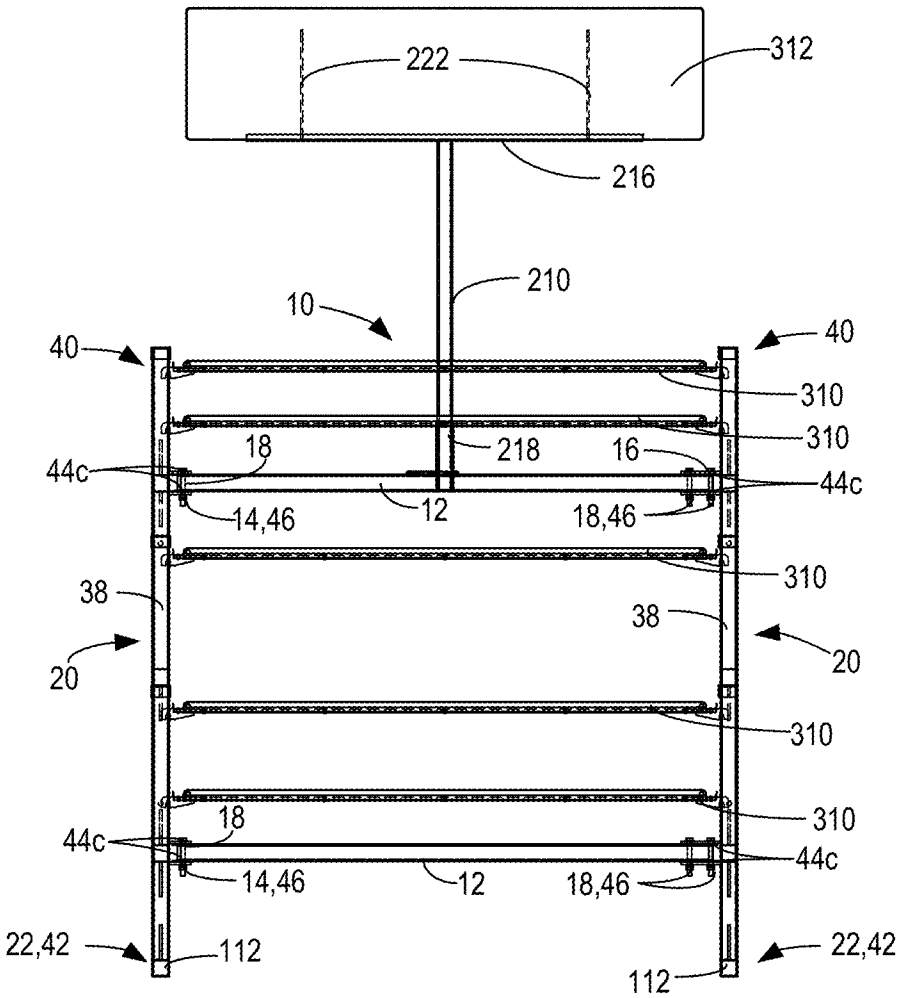
FIG. 1 shows a perspective view of a collapsible display bench with a sign and shelves in accordance with some embodiments or aspects of the present disclosure.
Figures 3, 4:
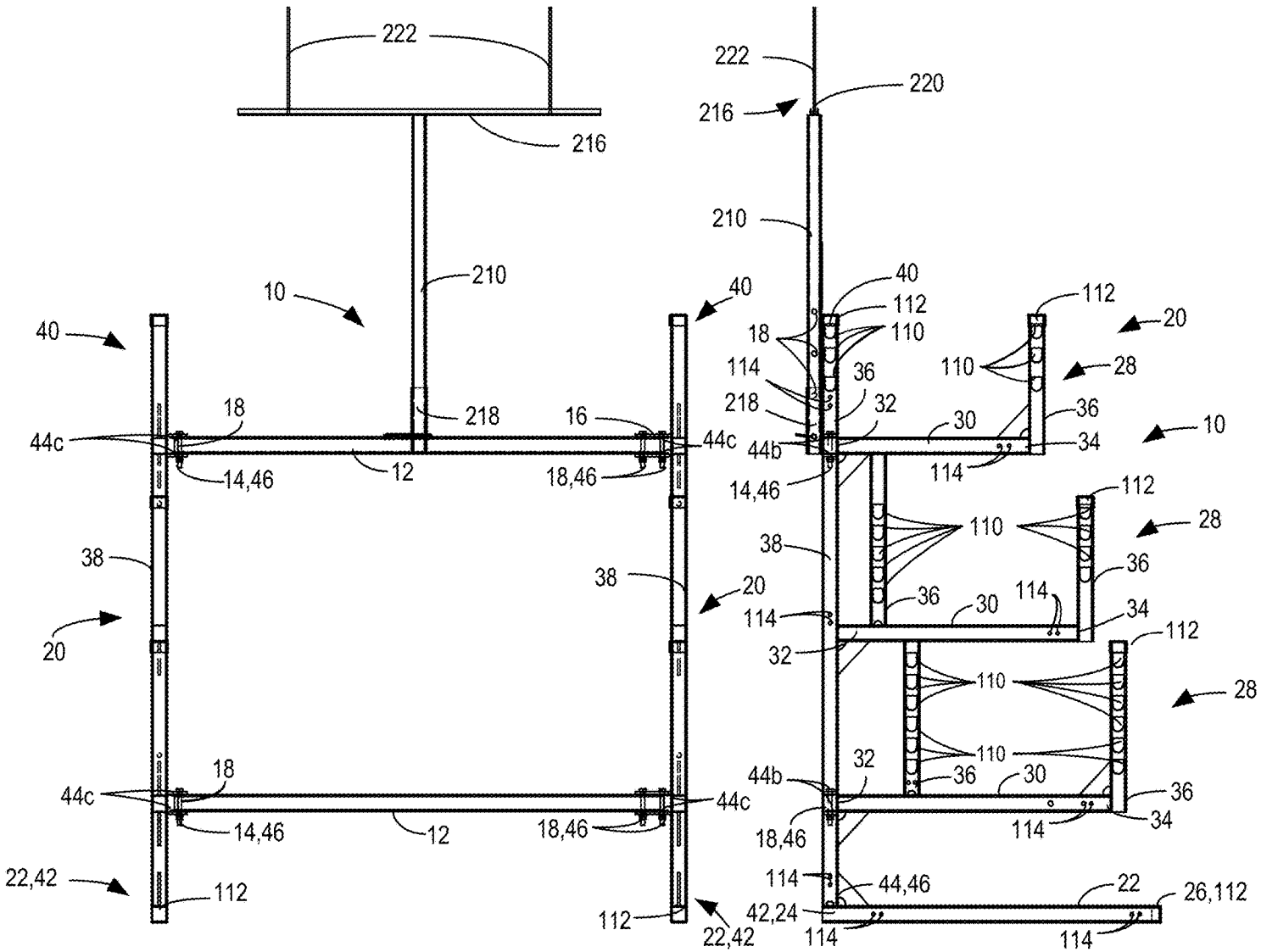
FIG. 3 shows a perspective view of collapsible display bench shown in FIG. 1 without a sign or shelves.
FIG. 4 shows a perspective view of collapsible display bench shown in FIG. 1 without a sign or shelves.

FIGS. 1-2 represent an embodiment of the present disclosure with shelves 310 and a sign 312 affixed to the collapsible display bench 10. FIGS. 3-4 show an embodiment without the shelves 310 and a sign 312 installed.

The notches 110 are shaped such that it is easier and more efficient for an individual installing the shelf 310 to fit the shelf 310 into the collapsible display bench 10. Namely, the notches 110 allow the shelf 310 to be installed at varying angles and to slide into place and remain stable.

Further referring to FIGS. 1-4, each leg 22 includes a proximal end 24 and a distal end 26. The arm 28 of the frame 20 is arranged as a horizontal beam 30 with a proximal end 32 and a distal end 34 orthogonally connected to two vertical shelf supports 36, one at the distal end of the horizontal beam 34 and the other disposed a distance along the length of the horizontal beam 30. The post 38 of the beam 30 has an upper end 40 and lower end 42. The proximal end of the leg 24 is connected to the lower end of post 42.

Figure 7:
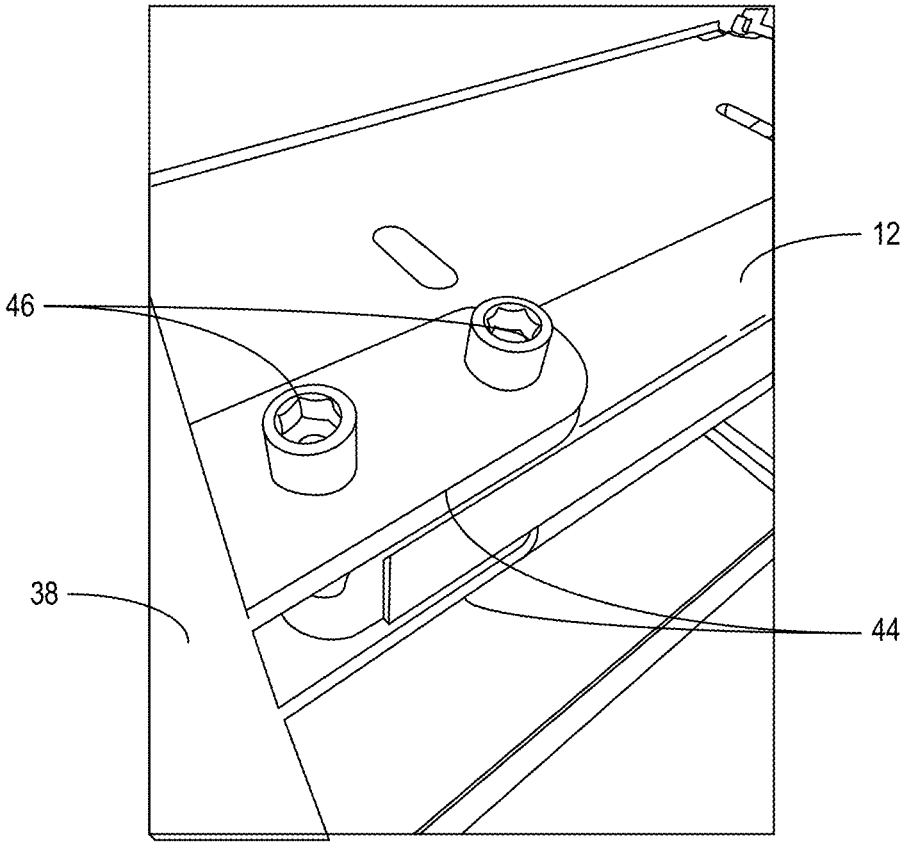
FIG. 7 shows a plate set with bolts according to some embodiments or aspects of the present disclosure.

Further referring to FIGS. 1-4 in addition to FIG. 7, the post 38 of a frame 20 has at least three plate sets 44 disposed along the height of the post 38. One plate set 44*a* at the lower end of the post 42 is positioned forward, at least one plate set 44*b* parallel or substantially parallel to the plate set at the lower end of the post 42, and at least one plate set 44*c* facing inward perpendicular to the plate set 44*a* at the lower end of the post 42.

Further referring to FIGS. 1-4, in certain embodiments, the horizontal bracing 12 of the collapsible display bench 10 includes a first end 14 and a second end 16. Both ends of the horizontal brace 12 are rounded and have two vertical through holes 18. Similarly, the proximal end of the leg 24 and the proximal end of the horizontal beam 32 both have two vertical through holes 18 and are rounded. These parts are rounded to facilitate their rotation described in the methods of using this collapsible display bench 10 hereinbelow.

Moreover, in certain embodiments, the two frames 20 are parallel or substantially parallel to each other and the posts 38 of the two frames 20 connected to either end of the horizontal bracing 14,16 by aligning the through holes 18 of the first end of the horizontal bracing 14 with the plate set 44*c* perpendicular to the plate set 44*a* at the lower end of the post 42 of one frame 20 and the second end of the horizontal bracing 16 with the plate set 44*c* perpendicular to the plate set 44*a* at the lower end of the post 42 of the other frame 20 and securing them with a bolt 46 in each hole respectively.

In certain embodiments, the proximal end of the leg 24 is connected to the lower end of post 42 by aligning the through holes 18 of the proximal end of the leg 24 and the plate set 44*a* at the lower end of the post 42 and securing them with a bolt 46 in each through hole 18 respectively. The proximal end of the horizontal beam 32 is connected to the post 38 by aligning the through holes 18 of the proximal end of the horizontal beam 32 and the plate set 44*b* parallel or substantially parallel to the plate set 44*a* at the lower end of the post 42 and securing them with a bolt 46 in each through hole 18 respectively.

Referring to FIGS. 1-4, the collapsible display bench 10 may include at least one additional notch 110 on each vertical shelf support 36. Each additional notch 110 may be provided at a substantially identical height on each vertical shelf support 36. This allows a shelf 310 to be installed at various heights and angles. Shelves 310 have hooks that can be disposed in the notches 310. Previous display benches required shelves 310 to be installed at an angle. The notches at multiple heights allow the shelves 310 to be installed at multiple heights on the vertical shelf support 36.

Referring to FIGS. 1-4, in certain embodiments, an end cap 112 is placed on the distal end of the legs 26, the upper end of the posts 40, and the tops of the vertical shelf supports 36. The end caps 112 can be made of rubber, plastic, or any material that shields the open ends of the collapsible display bench 10. The end caps 112 mitigate health and safety risks by covering exposed ends of the collapsible display bench 10. This prevents water from going into the collapsible display bench 10 preventing possible corrosion or mold growth. Additionally, the end caps 112 cover ends of collapsible display bench 10 ensuring that any sharp edges are covered preventing cuts and scrapes.

Referring to FIGS. 1-4, in certain embodiments, the vertical shelf supports 36 and posts 38 have holes 114 on the outside face of the collapsible display bench 10 to allow a banner to be fixed to the collapsible display bench 10. These banners can be promotional materials, information, decorative, or for any purpose someone sees fit. These holes 114 can be flat or threaded and a banner could be attached via a peg, bolt, string, or anything sufficient to hold a banner to the collapsible display bench 10.

Referring to FIGS. 1-5, in certain embodiments, the collapsible display bench 10 includes a rod 210, with a lower end 212, upper end 214, and at least two through holes 18 along the rod 210. The upper end of the rod 212 has a holder 216 to hold a sign 312. A tube 218 may be perpendicularly attached to the horizontal bracing 12. The interior may be the same shape as the exterior of the rod 210. The tube 218 has a through hole 18, The rod 210 is disposed within the tube 218 and fixed in a position by aligning one through hole of the rod 210 with the through hole of the tube 218 and securing with a bolt 46.

Figure 5:
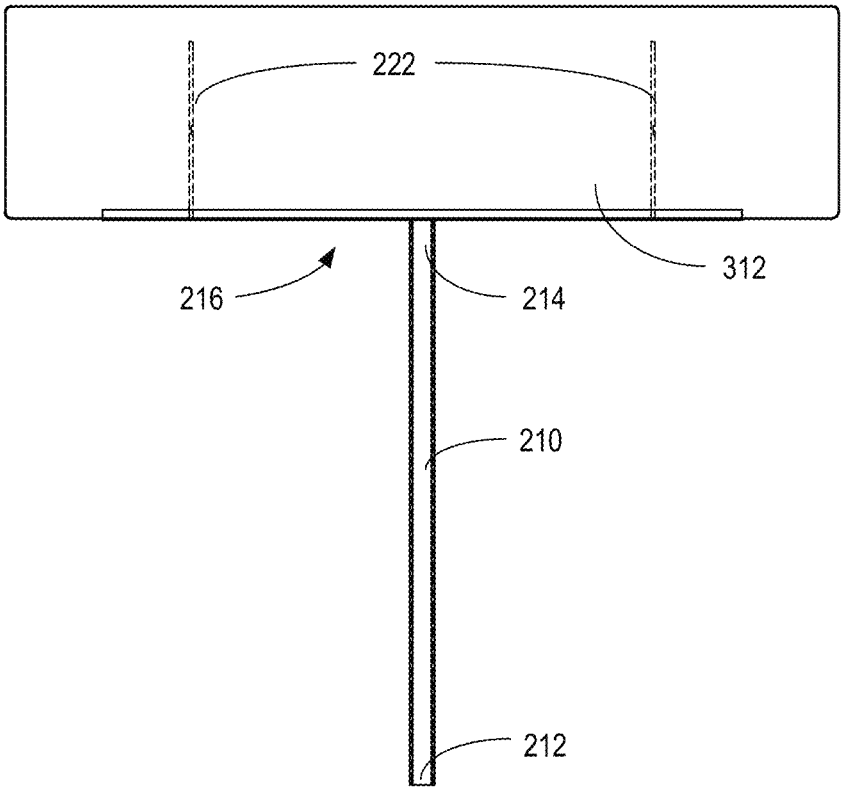
FIG. 5 shows a perspective view of a rod and holder with a sign in accordance with some embodiments or aspects of the present disclosure.
Figure 6:
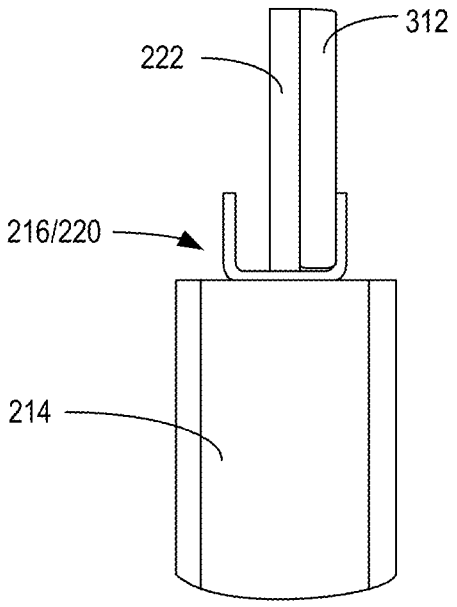
FIG. 6 shows a side cross-sectional view of rod and holder with a sign shown in FIG. 6.

Referring to FIGS. 5-6, in certain embodiments, the holder 216 includes a U-shaped cross section 220 extended perpendicular to the rod 210. At least one backing support 222 bisects the U-shaped cross section 220. A sign 312 may be slid into the holder 216 on either side of the backing support 222 into the channel created by the U-shaped cross section 220.

Referring to FIG. 7, in certain embodiments, the plate sets 44 include two plates arranged parallel to each other at a height substantially equivalent to the height of the leg 22, arm 28, and horizontal bracing 12 respectively, with two through holes 18.

Further, referring to FIG. 7, in certain embodiments, the head of each bolt 46 is fit for a hex key, also known as an Allen wrench. This allows for the collapsible display bench 10 to be easily and efficiently assembled and disassembled yet remain secure when setup.

Figure 8:
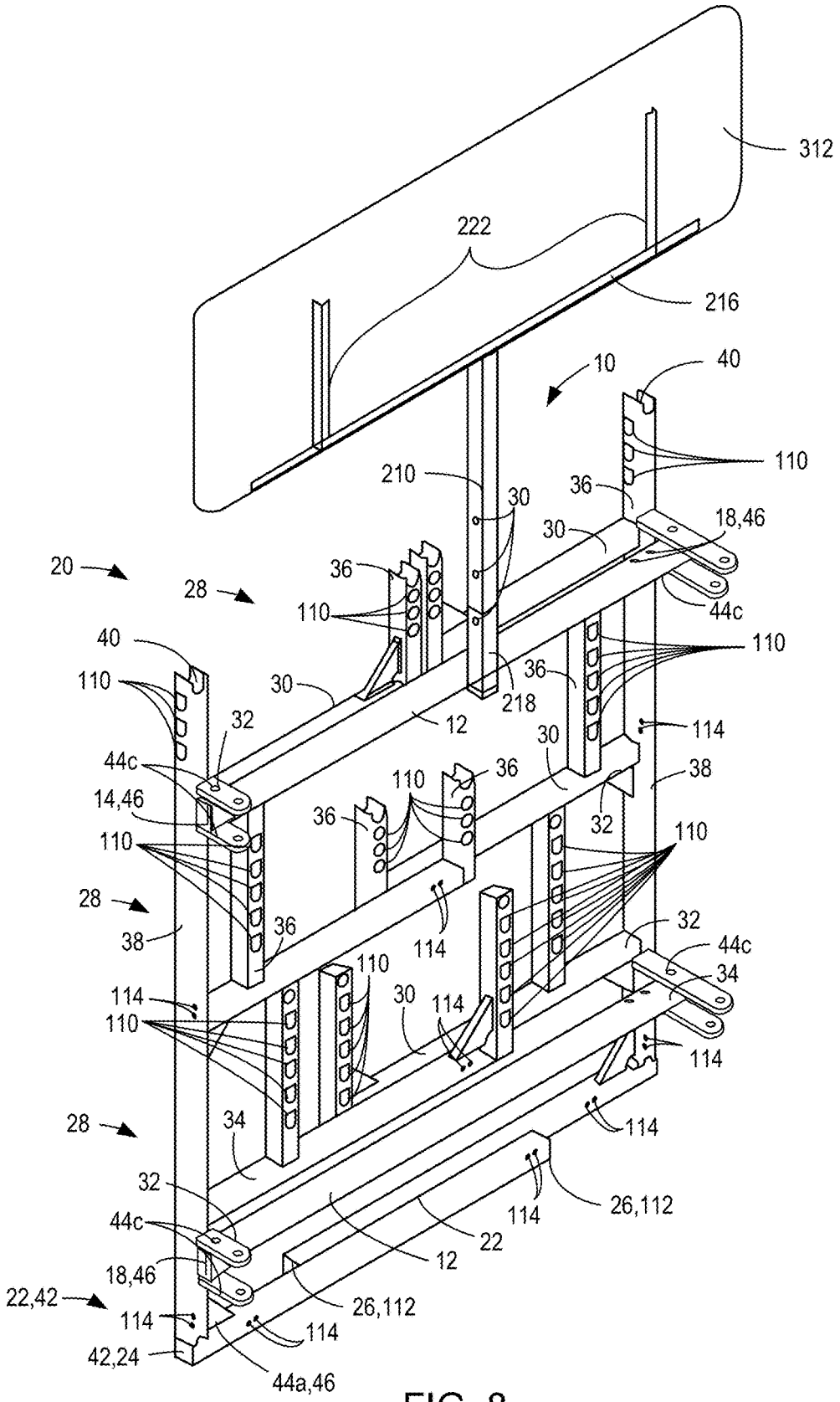
FIG. 8 shows a perspective view of a collapsible display bench in a collapsed state in accordance with some embodiments of the present disclosure.

Referring to FIG. 8, a collapsible display bench 10 may be collapsed by using a hex key to loosen a bolt 46 from one of the two through holes 18 of each of the plate sets 44, removing the loosened bolt 46 from each of the plate sets 44; rotating the at least one arm 28 of a frame 20 inwards towards the horizontal bracing 12; rotating the at least one arm 28 of the other frame 20 inwards towards the horizontal bracing 12; rotating the leg 22 of a frame 20 inwards towards the horizontal bracing 12; and rotating the leg 22 of the other frame 20 inwards towards the horizontal bracing 12. Alternatively, the collapsible display bench 10 may be collapsed by using a hex key to loosen a bolt 46 from one of the two through holes 18 of the plate set 44 securing the horizontal bracing 12; removing the loosened bolt 46 from the plate sets 44; rotating a frame 20 inwards towards the horizontal bracing 12; and rotating the other frame 20 inwards towards the horizontal bracing 12. Collapsing the collapsible display bench 10 in this manner can be accomplished by just a few people and, as described above, with more ease due to the use of a hex key as opposed to a Phillips or flat head bolt 46. Once the collapsible display bench 10 is collapsed, the collapsible display bench 10 can be easily stored for storage or transport due to its relatively flat profile.

In further embodiments, the distal end of at least one arm 28 of a frame 20 is secured to the horizontal bracing 12, the distal end of at least one arm 28 of the other frame 20 is secured to the horizontal bracing 12, the distal end of the leg 22 of a frame 20 is secured to the horizontal bracing 12, and the distal end of the leg 22 of the other frame 20 is secured to the horizontal bracing 12. This allows the collapsible display bench 10 to securely stay in a collapsed state. This will prevent injury and make it easier to transport the collapsible display bench 10 in the collapsed state. The parts of the collapsible display bench 10 may be secured using a bracket, rope, or anything sufficient to hold the parts in the collapsed state.

What is claimed is:

1. A collapsible display bench comprising:
at least one horizontal bracing;
two frames that are mirrored versions of each other;
the frames comprising:
a leg with a proximal end and a distal end; and
at least one arm;
wherein, the arm comprises a horizontal beam with a proximal end and a distal end orthogonally connected to two vertical shelf supports one at the distal end of the horizontal beam and the other disposed a distance along the length of the horizontal beam,
wherein there is a notch at the top of each vertical shelf support,
a post with an upper end and lower end;
wherein, the post has at least three plate sets disposed along the height of the post, one plate set at the lower end of the post positioned forward, at least one plate set parallel to the plate set at the lower end of the post, and at least one plate set facing inward perpendicular to the plate set at the lower end of the post,
wherein the proximal end of the leg is connected to the lower end of post,
wherein the two frames are parallel to each other and the posts of the two frames connected to a respective one of the ends of the horizontal bracing.

2. The collapsible display bench of claim 1, wherein the ends of the horizontal bracing comprise:
a first end and a second end wherein both ends are rounded and have two vertical through holes.

3. The collapsible display bench of claim 2, wherein the posts of the two frames connected to the either end of the horizontal bracing by aligning the vertical through holes of the first end of the horizontal bracing with the plate set perpendicular to the plate set at the lower end of the post of one frame and the second end of the horizontal bracing with the plate set perpendicular to the plate set at the lower end of the post of the other frame and securing them with a bolt in each vertical through hole respectively.

4. The collapsible display bench of claim 3, wherein the proximal end of the leg has two vertical through holes and is rounded.

5. The collapsible display bench of claim 4, wherein the proximal end of the leg is connected to the lower end of the post by aligning the vertical through holes of the proximal end of the leg and the plate set at the lower end of the post and securing them with a bolt in each vertical through hole respectively, and the proximal end of the arm is connected to the post by aligning the through vertical through holes of the proximal end of the arm and the plate set parallel to the plate set at the lower end of the post and securing them with a bolt in each vertical through hole respectively.

6. The collapsible display bench of claim 5, wherein, the proximal end of the horizontal beam has two vertical through holes and is rounded.

7. The collapsible display bench of claim 6, wherein, the plate sets comprises two plates arranged parallel to each other at a height substantially equivalent to the height of the leg, arm, and horizontal bracing respectively, with two through holes.

8. The collapsible display bench of claim 7, wherein the head of each bolt is fit for a hex key.

9. The collapsible display bench of claim 1, wherein the notch comprises a rounded opening.

10. The collapsible display bench of claim 1, wherein there is at least one additional notch on each vertical shelf support, each additional notch at a substantially identical height on each vertical shelf support.

11. The collapsible display bench of claim 1, wherein an end cap is placed on the distal end of the legs, the upper end of the posts and the tops of the vertical shelf supports.

12. The collapsible display bench of claim 1, wherein the vertical shelf supports and posts have holes on the outside face of the collapsible display bench to allow a banner to be fixed to the collapsible display bench.

13. The collapsible display bench of claim 1, further comprising:
a rod, with a lower end, upper end, and at least two through holes along the rod,
wherein the upper end of the rod has a holder to hold a sign,
wherein there is a tube perpendicularly attached to the horizontal bracing, the interior of the tube is the same shape as the exterior of the rod and the tube has a through hole,
wherein the rod is disposed with in the tube and fixed in a position by aligning one through hole of the rod with the through hole of the tube and securing with a bolt.

14. The collapsible display bench of claim 13, wherein the holder comprises:
a U-shaped cross section extended perpendicular to the rod; and,
at least one backing support bisecting the U-shaped cross section.

15. A method of using a collapsible display bench comprising:
providing a collapsible bench as recited in claim 1;
using a hex key to loosen a bolt from one of two through holes of each of the plate sets,
removing the loosened bolt from each of the plate sets;
rotating the at least one arm of one of the frames inwards towards the at least one horizontal bracing;
rotating the at least one arm of the other frame inwards towards the horizontal bracing;
rotating the leg of one of the frames inwards towards the at least one horizontal bracing; and
rotating the leg of the other frame inwards towards the at least one horizontal bracing.

16. The method of claim 15 further comprising:
securing the distal end of the at least one arm of one of the frames to the at least one horizontal bracing,
securing the distal end of the at least one arm of the other frame to the at least one horizontal bracing,
securing the distal end of the leg of one of the frames to the at least one horizontal bracing,
securing the distal end of the leg of the other frame to the at least one horizontal bracing.

17. The method of claim 16 wherein, the at least one arm of one of the frames is secured to the at least one horizontal bracing by a bracket, the distal end of at least one arm of the other frame is secured to the at least one horizontal bracing by a bracket, the distal end of the leg of one of the frames is secured to the at least one horizontal bracing by a bracket, the distal end of the leg of the other frame is secured to the at least one horizontal bracing by a bracket.

18. A method of using a collapsible display bench comprising:

providing a collapsible display bench as recited in claim 1;

using a hex key to loosen a bolt from one of two through holes of the plate set securing the at least one horizontal bracing;

removing the loosened bolt from the plate set;

rotating a frame inwards towards the at least one horizontal bracing;

rotating the other frame inwards towards the at least one horizontal bracing.

19. The method of claim 18 further comprising:

securing the distal end of the at least one arm of one of the frames to the at least one horizontal bracing, securing the distal end of the at least one arm of the other frame to the at least one horizontal bracing, securing the distal end of the leg of one of the frames to the at least one horizontal bracing, securing the distal end of the leg of the other frame to the at least one horizontal bracing.

20. The method of claim 19 wherein, the at least one arm of one of the frames is secured to the at least one horizontal bracing by a bracket, the distal end of at least one arm of the other frame is secured to the at least one horizontal bracing by a bracket, the distal end of the leg of one of the frames is secured to the at least one horizontal bracing by a bracket, the distal end of the leg of the other frame is secured to the at least one horizontal bracing by a bracket.

* * * * *